United States Patent [19]

Uhri

[11] Patent Number: 4,714,115

[45] Date of Patent: Dec. 22, 1987

[54] HYDRAULIC FRACTURING OF A SHALLOW SUBSURFACE FORMATION

[75] Inventor: Duane C. Uhri, Grand Prairie, Tex.

[73] Assignee: Mobil Oil Corporation, New York, N.Y.

[21] Appl. No.: 938,892

[22] Filed: Dec. 8, 1986

[51] Int. Cl.[4] ..... E21B 43/26

[52] U.S. Cl. ..... 166/308

[58] Field of Search ..... 166/250, 263, 271, 283, 166/308

[56] References Cited

U.S. PATENT DOCUMENTS

| | | | |
|---|---|---|---|
| 3,586,105 | 6/1971 | Johnson | 166/250 |
| 3,965,982 | 6/1976 | Medlin | 166/249 |
| 4,005,750 | 2/1977 | Shuck | 166/308 |
| 4,067,389 | 1/1978 | Savins | 166/308 X |
| 4,220,205 | 9/1980 | Coursen et al. | 166/250 X |
| 4,378,845 | 4/1983 | Medlin et al. | 166/297 |
| 4,440,226 | 4/1984 | James | 166/127 X |
| 4,442,895 | 4/1984 | Lagus et al. | 166/250 |
| 4,453,595 | 6/1984 | Lagus et al. | 166/250 |
| 4,515,214 | 5/1985 | Fitch et al. | 166/250 |
| 4,549,608 | 10/1985 | Stowe et al. | 166/280 |
| 4,577,689 | 3/1986 | Dotson | 166/250 |

*Primary Examiner*—George A. Suchfield

*Attorney, Agent, or Firm*—Alexander J. McKillop; Michael G. Gilman; George W. Hager, Jr.

[57] ABSTRACT

A subsurface formation having original in-situ stresses that favor the propagation of a horizontal fracture is penetrated by a cased borehole which is perforated at a pair of spaced-apart intervals to form a pair of sets of perforations. Fracturing fluid is initially pumped down said cased borehole and out one of said sets of perforations to form the originally favored horizontal fracture. The propagation of this horizontal fracture changes the in-situ stresses so as to favor the propagation of a vertical fracture. Thereafter, while maintaining pressure on said horizontal fracture, fracturing fluid is pumped down said cased borehole and out of the other of said sets of perforations to form the newly favored vertical fracture.

11 Claims, 3 Drawing Figures

HYDRAULIC FRACTURING OF A SHALLOW SUBSURFACE FORMATION

CROSS REFERENCE TO RELATED APPLICATIONS

This application is related to U.S. application Ser. No. 938,891, filed on the same date and herewith, and now U.S. Pat. No. 4,687,061, entitled STIMULATION OF EARTH FORMATIONS SURROUNDING A DEVIATED WELLBORE BY SEQUENTIAL HYDRAULIC FRACTURING to the same inventor herewith.

BACKGROUND OF THE INVENTION

This invention relates to the hydraulic fracturing of subterranean formations and more particularly to the forming of a vertical hydraulic fracture in a subterranean formation that is normally disposed to form a horizontal hydraulic fracture.

In the completion of wells drilled into the earth, a string of casing is normally run into the well and a cement slurry is flowed into the annulus between the casing string and the wall of the well. The cement slurry is allowed to set and form a cement sheath which bonds the string of casing to the wall of the well. Perforations are provided through the casing and cement sheath adjacent the subsurface formation. Fluids, such as oil or gas, are produced through these perforations into the well.

Hydraulic fracturing is widely practiced to increase the production rate from such wells. Fracturing treatments are usually performed soon after the formation interval to be produced is completed, that is, soon after fluid communication between the well and the reservoir interval is established. Wells are also sometimes fractured for the purpose of stimulating production after significant depletion of the reservoir.

Hydraulic fracturing techniques involve injecting a fracturing fluid down a well and into contact with the subterranean formation to be fractured. Sufficiently high pressure is applied to the fracturing fluid to initiate and propagate a fracture into the subterranean formation. Proppant materials are generally entrained in the fracturing fluid and are deposited in the fracture to maintain the fracture open.

Several such hydraulic fracturing methods are disclosed in U.S. Pat. Nos. 3,965,982; 4,067,389; 4,378,845; 4,515,214; and 4,549,608 for example. It is generally accepted that the in-situ stresses in the formation at the time of such hydraulic fracturing generally favor the formation of vertical fractures in preference to horizontal fractures at depths greater than about 2000 to 3000 ft. while at shallower depths such in-situ stresses can favor the formation of horizontal fractures in preference to vertical fractures.

For oil or gas reservoirs found at such shallow depths, significant oil or gas production stimulation could be realized if such reservoir were vertically fractured. For example, steam stimulation of certain heavy oil sands would be enhanced and productivity would be optimized in highly stratified reservoirs with low vertical permeability.

It is therefore a specific object of the present invention to provide for a hydraulic fracturing method that produces a vertical fracture in a subsurface formation where the in-situ stresses favor a horizontal fracture.

SUMMARY OF THE INVENTION

The present invention is directed to a hydraulic fracturing method for propagating a vertical fracture in an earth formation surrounding a borehole wherein the original in-situ stresses favor a horizontal fracture.

More particularly, a fracturing fluid is first applied to the formation at a first depth within the borehole to propagate a horizontal fracture as favored by such original in-situ stresses. The propagation of this horizontal fracture changes the in-situ stresses so as to favor the propagation of a vertical fracture. Thereafter, a fracturing fluid is applied to the same formation at a second depth within the borehole, while maintaining pressure on the horizontal fracture, to propagate the now favored vertical fracture. The vertical fracture may be propagated either above or below the horizontal fracture. If it is desirable to limit both the upward and downward growth of the vertical fracture, two spaced-apart horizontal fractures may initially be propagated followed by the propagation of the vertical fracture therebetween.

In a more specific aspect, casing is set within the borehole and is perforated at first and second spaced-apart intervals along the borehole to form a pair of sets of perforations. Fracturing fluid is pumped through one of such sets of perforations to initially propagate a horizontal fracture as favored by the original in-situ stresses of the formation. Thereafter, while maintaining pressure on the horizontal fracture, fracturing fluid is pumped out the remaining set of perforations to propagate a vertical fracture as favored by the in-situ stresses of the formation as altered during the propagation of the pair of horizontal fractures.

DESCRIPTION OF THE PREFERRED EMBODIMENT

Figure 1:
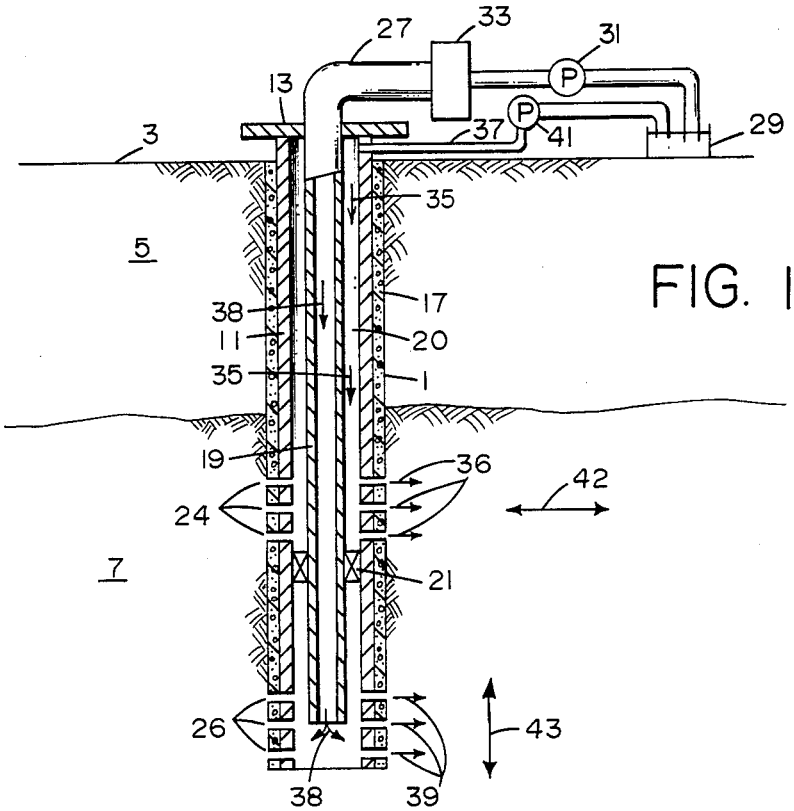
FIG. 1 illustrates a borehole apparatus penetrating an earth formation to be hydraulically fractured in accordance with the present invention.

Referring now to FIG. 1 there is shown formation fracturing apparatus within which the hydraulic fracturing method of the present invention may be carried out. A wellbore 1 extends from the surface 3 through an overburden 5 to a shallow productive formation 7 where the in-situ stresses favor a horizontal fracture. Casing 11 is set in the wellbore and extends from a casing head 13 to the productive formation 7. The casing 11 is held in the wellbore by a cement sheath 17 that is formed between the casing 11 and the wellbore 1. The casing 11 and cement sheath 17 are perforated at 24 where the local in-situ stresses favor the propagation of a horizontal fracture and at 26 where the lcoal in-situ stresses also favor the propagation of a horizontal fracture. A tubing string 19 is positioned in the wellbore and extends from the casing head 13 to the lower end of the wellbore below the perforations 26. A packer 21 is placed in the annulus 20 between the perforations 24 and 26. The upper end of tubing 19 is connected by a conduit 27 to a source 29 of fracturing fluid. A pump 31 is provided in communication with the conduit 27 for pumping the fracturing fluid from the source 29 down the tubing 19. The upper end of the annulus 20 between the tubing 19 and the casing 11 is connected by a conduit 37 to the source 29 of fracturing fluid. A pump 41 is provided in fluid communication with the conduit 37 for pumping fracturing fluid from the source 29 down the annulus 20.

In carrying out the hydraulic fracturing method of the present invention with the apparatus of FIG. 1 in a zone of the formation where the in-situ stresses favor a horizontal fracture, such a horizontal fracture 42 is initially propagated by activating the pump 41 to force fracturing fluid down the annulus 20 as shown by arrows 35 through the performations 24 into the formation as shown by arrows 36 at a point immediately above the upper packer 21. The fact that this will be a horizontal fracture in certain formations can best seen by reference to FIG. 2 where three orthogonal principle original in-situ stresses are operative. These in-situ stresses are a vertical stress ($\sigma_v$) of 1800 psi for example, a minimum horizontal stress ($\sigma_h$min) of 1100 psi for example, and a maximum horizontal stress ($\sigma_h$max) of 1300 psi for example.

The mean horizontal stress ($\overline{\sigma}_h$) is, therefore 1200 psi. This results in a ratio of mean horizontal stress to vertical stress ($\overline{\sigma}_h/\sigma_v$) of 0.667. Using this value and the equations set forth in "Introduction to Rock Mechanics"by R. E. Goodman, John Wiley and Sons, N.Y., 1980, pps. 111–115, a vertical stress of greater than 2000 psi is required for a vertical fracture to form. Typical range of $\overline{\sigma}_h/\sigma_v$ are 0.5 to 0.8 for hard rock and 0.8 to 1.0 for soft rock such as shale or salt. For the foregoing example, a fluid pressure of 1900 psi is maintained during the initial propagation of a horizontal fracture 42 by controlling the fracturing fluid flow rate through annulus 20 or by using well known gelling agents.

Figure 2:
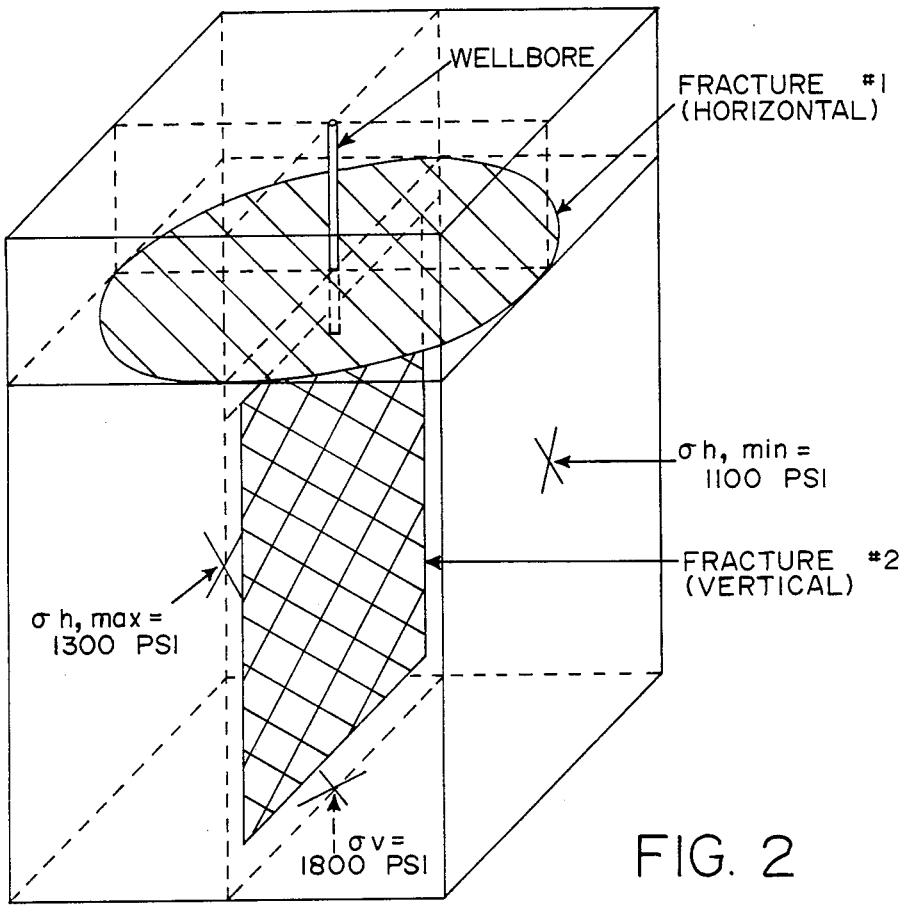
FIG. 2 is a pictorial representation of hydraulic fractures, formed in the earth formation by use of the apparatus of FIG. 1.

Due to the pressure in the horizontal fracture 42, the local in-situ stresses in the formation 7 are now altered from the original stresses of FIG. 2 to favor the formation of a vertical fracture 43. Such a vertical fracture 43 can thereafter be formed in formation 7 by activating the pump 31 to force fracturing fluid out the bottom of tubing 19 as shown by arrows 38 and through the perforations 26 into the formation as shown by arrows 39 at a point near the bottom of the wellbore. This vertical fracture 43 is propagated while maintaining the fluid pressure on the horizontal fracture 42, which can either be stabilized in length or still propagating.

The height of vertical fracture 43 is relative to that of the horizontal fracture 42. For an essentially circular horizontal fracture, the height of the vertical fracture is about equal to the diameter of the horizontal fracture. Should the vertical fracture become too large relative to the horizontal fracture, it will curve and eventually become a horizontal fracture at some distance from the well.

Instead of forming the horizontal fracture 42 above the vertical fracture 43 as described above and as shown in FIG. 2, the fracturing fluid could be firstly pumped down tubing 19 and out perforations 26 to form the horizontal fracture near the bottom of the wellbore and thereafter pumping the fracturing fluid down the annulus between the casing 11 and tubing 19 and out perforations 24 to form the vertical fracture.

Figure 3:
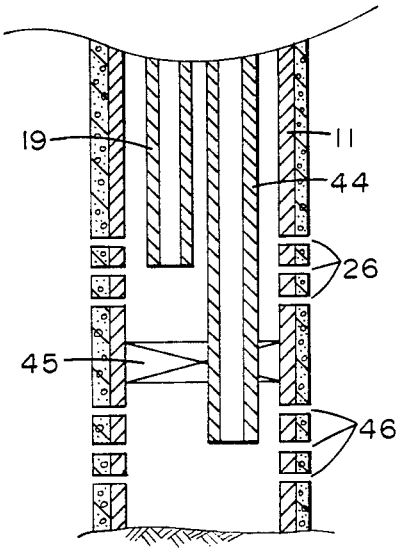
FIG. 3 is a partial view of the bottom portion of the apparatus of FIG. 1 showing additional features of an alternate embodiment in accordance with the present invention.

Further, both the upward and downward growth of the vertical fracture can be contained by producing a horizontal fracture both above and below the desired location for the vertical fracture. This would require the extension of the casing 11 to a lower depth in the formation as well as require an additional tubing 44 and perforations 46 for applying fracturing fluid to this lower depth point in the formation as shown in FIG. 3. An additional packer 45 is required immediately below the bottom end of tubing 19.

Having now described a preferred embodiment for the method of the present invention, it will be apparent to those skilled in the art of hydraulic fracturing that various changes and modifications may be made without departing from the spirit and scope of the invention as set forth in the appended claims. Any such changes and modifications coming within the scope of such appended claims are intended to be included herein.

I claim:

1. A method for propagating a vertical hydraulic fracture in an earth formation surrounding a borehole where the original in-situ stresses favor a horizontal fracture, comprising the steps of:

(a) firstly supplying fracturing fluid to said formation at a first depth within said borehole to propagate a horizontal fracture favored by the original in-situ stresses of the formation, and (b) secondly supplying fracturing fluid to said formation at a second depth within said borehole, while maintaining pressure in said horizontal fracture, to propagate a vertical fracture as favored by the in-situ stresses as altered by the propagating of said horizontal fracture.

2. The method of claim 1 wherein said second depth is below said first depth such that said vertical fracture is propagated underneath said horizontal fracture.

3. The method of claim 1 wherein said second depth is above said first depth such that said vertical fracture is propagated above said horizontal fracture.

4. A method for propagating a vertical hydraulic fracture in an earth formation surrounding a borehole where the original in-situ stresses favor a horizontal fracture, comprising the steps of:

(a) firstly supplying fracturing fluid under pressure to said formation at first and second depths within said borehole to propagate horizontal fractures at said first and second depths as favored by the original in-situ stresses of the formation, and (b) secondly supplying fracturing fluid under pressure to said formation at a third depth between said first and second depths within said borehole, while maintaining pressure in said horizontal fractures, to propagate a vertical fracture as favored by the in-situ stresses as altered by the propagating of said horizontal fractures, such that the upward and downward growth of said vertical fracture is contained by said horizontal fractures.

5. A method for propagating a vertical hydraulic fracture in an earth formation surrounding a borehole where the original in-situ stresses favor a horizontal fracture, comprising the steps of:

(a) setting borehole casing through said formation, (b) perforating said casing at first and second spaced-apart intervals along said borehole to form first and second sets of perforations;

(c) pumping fracturing fluid into said formation through said first set of perforations to propagate a horizontal fracture as favored by the original in-situ stresses of said formations, and (d) pumping fracturing fluid into said formation through said second set of perforations, while maintaining pressure in said horizontal fracture, to propagate a vertical fracture as favored by the in-situ stresses of said formation as altered by the propagation of said horizontal fracture.

6. The method of claim 5 wherein said second set of perforations are formed below said first set of perforations such that said vertical fracture is propagated below said horizontal fracture with its upward growth being limited by said horizontal fracture.

7. The method of claim 5 wherein said second set of perforations are formed above said first set of perforations such that said vertical fracture is propagated above said horizontal fracture with its downward growth being limited by said horizontal fracture.

8. The method for propagating a vertical hydraulic fracture in an earth formation surrounding a borehole where the original in-situ stresses favor a horizontal fracture, comprising the steps of:

(a) setting borehole casing through said formation, (b) perforating said casing at first, second and third-spaced apart intervals along said borehole to form first, second and third sets of perforations, said second set of perforations being formed between said first and third sets of perforations, (c) pumping fracturing fluid into said formation through said first and third sets of perforations to propagate a pair of spaced-apart horizontal fractures as favored by the original in-situ stresses of said formations; and (d) pumping fracturing fluid into said formation through said second set of perforations, while maintaining pressure in said horizontal fractures, to propagate a vertical fracture between said pair of horizontal fractures as favored by the in-situ stresses of the formation as altered by the propagation of said pair of horizontal fractures.

9. A method for propagating a vertical hydraulic fracture in an earth formation surrounding a borehole where the original in-situ stresses favor a horizontal fracture, comprising the steps of:

(a) setting casing in a borehole pentrating said formation;

(b) generating upper perforations in said casing at a depth where the local in-situ stresses of the formation favor the propagation of a horizontal fracture;

(c) generating lower perforations in said casing at a depth where the local in-situ stresses of the formation favor the propagation of a horizontal fracture;

(d) hanging tubing within said casing to the depth of said lower perforations, an annulus being formed between said tubing and said casing;

(e) placing a packer in said annulus between said upper and said lower perforations;

(f) supplying fracturing fluid under pressure through said annulus and said upper perforations to said formation to propagate a horizontal fracture through said formation as favored by the original in-situ stresses of said formation, said horizontal fracturing altering the original in-situ stresses of the formation to favor the propagation of a vertical fracture, and (g) supplying fracturing fluid under pressure through said tubing and said lower perforations to said formation to propagate a vertical fracture through said formation, while maintaining pressure in said horizontal fracture, as favored by the altering of said original in-situ stresses during the propagation of said horizontal fracture, the upward growth of said vertical fracture being contained by said horizontal fracture.

10. A method for propagating a vertical hydraulic fracture in an earth formation surrounding a borehole where the original in-situ stresses favor a horizontal fracture, comprising the steps of:

(a) setting casing in a borehole pentrating said formation, (b) generating upper perforations in said casing at a depth where the local in-situ stresses of the formation favor the propagation of a horizontal fracture;

(c) generating lower perforations in said casing at a depth where the local in-situ stresses of the formation favor the propagation of a horizontal fracturing;

(d) hanging tubing within said casing to the depth of said lower perforations, an annulus being formed between said tubing and said casing, (e) placing an upper packer in said annulus between said upper and said lower perforations, (f) supplying fracturing fluid under pressure through said tubing and said lower perforations to said formation to propagate a horizontal fracture through said formation as favored by the original in-situ stresses of said formation, said horizontal fracturing altering the original in-situ stresses of the formation to favor the propagation of a vertical fracture, and (g) supplying fracturing fluid under pressure through said annulus and said upper perforations to said foramtion, while maintaining pressure on said horizontal fracture, to propagate a vertical fracture through said formation as favored by the altering of said original in-situ stresses during the propagation of said horizontal fracture, the downward growth of said vertical fracture being contained by said horizontal fracture.

11. A method for propagating a vertical hydraulic fracture in an earth formation surrounding a borehole where the original in-situ stresses favor a horizontal fracture, comprising the steps of:

(a) setting casing in a borehole pentrating said formation, (b) generating first perforations in said casing at a first depth where the local in-situ stresses of the formation favor the propagation of a horizontal fracture, (c) generating second perforations in said casing at a second depth where the local in-situ stresses of the formation favor the propagation of a horizontal fracture, (d) generating third perforations in said casing at a third depth where the local in-situ stresses of the formation favor the propagation of a horizontal fracture, (e) hanging first and second tubings within said casing, the bottom ends of said first and second tubings extending to the depths of said second and third perforations respectively, (f) placing a first packer in the annulus between said casing and said first and second tubings and between said first and second perforations, (g) placing a second packer in the annulus between said casing and said second tubing below the bottom end of said first tubing and between said second and third perforations, (h) supplying fracturing fluid under pressure through the annulus between said casing and first and second tubings and out said first perforations, and through said second tubing and out said third perforations so as to simultaneously propagate a pair of spaced-apart horizontal fractures in the formation as favored by the original in-situ stresses of the formation, said pair of horizontal fractures altering the in-situ stresses of the formation to thereafter favor the formation of a vertical fracture, and (i) supplying fracturing fluid under pressure through said first tubing and out said second perforations, while maintaining pressure on said pair of horizontal fractures, to propagate a vertical fracture in the formations favored by the altered in-situ stresses of the formation.

* * * * *